US011402092B2

(12) United States Patent
Caloca et al.

(10) Patent No.: US 11,402,092 B2
(45) Date of Patent: Aug. 2, 2022

(54) BURNER WITH MULTIPLE SECTIONS AND CONTROL FOR ADAPTABLE USE

(71) Applicant: WHIRLPOOL CORPORATION, Benton Harbor, MI (US)

(72) Inventors: Victor Gerardo Caloca, Celaya (MX); Victor H. Manrique, St. Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 13 days.

(21) Appl. No.: 16/930,625

(22) Filed: Jul. 16, 2020

(65) Prior Publication Data

US 2022/0018534 A1 Jan. 20, 2022

(51) Int. Cl.

| | |
|---|---|
| ***F23D 14/58*** | (2006.01) |
| ***F23D 11/40*** | (2006.01) |
| ***F23D 11/42*** | (2006.01) |
| *F24C 3/08* | (2006.01) |

(52) U.S. Cl.

CPC ..... *F23D 14/58* (2013.01); *F23D 11/402* (2013.01); *F23D 11/42* (2013.01); *F24C 3/085* (2013.01)

(58) Field of Classification Search

None

See application file for complete search history.

(56) References Cited

U.S. PATENT DOCUMENTS

| | | | |
|---|---|---|---|
| 5,842,849 | A | 12/1998 | Huang |
| 7,527,495 | B2 | 5/2009 | Yam et al. |
| 7,878,800 | B2 | 2/2011 | Bettinzoli |
| 8,978,637 | B2 | 3/2015 | Ryu et al. |
| 9,557,063 | B2 | 1/2017 | Cadima |
| 9,995,490 | B2 | 6/2018 | Cadima |
| 10,036,557 | B2 | 7/2018 | Ceccoli |
| 10,274,202 | B2 | 4/2019 | Cadima |
| 2015/0144123 | A1 | 5/2015 | Cadima |
| 2016/0025348 | A1 | 1/2016 | Cadima |

FOREIGN PATENT DOCUMENTS

| | | | |
|---|---|---|---|
| EP | 3343107 | A1 | 10/2017 |

*Primary Examiner* — Jason Lau

(74) *Attorney, Agent, or Firm* — Price Heneveld LLP

(57) ABSTRACT

A cooking burner includes a spreader defining a first side wall defining an outer profile having first and second extension sections opposed about a first axis. The spreader further defines first and second arced sections, each extending outwardly along a second axis perpendicular to the first axis from and between parallel straight segments of the first and second extension sections, respectively. The spreader further defines a second side wall disposed inwardly of and concentric with the first and second arced sections and a plurality of fuel outlets extending through both the first side wall and the second side wall. A circular inner cap is assembled with an upper portion of the circular inner profile, an annular outer cap is assembled with respective upper portions of the first and second arced sections, and first and second extension caps assembled with respective upper portions of the first and second extension sections.

19 Claims, 13 Drawing Sheets

BURNER WITH MULTIPLE SECTIONS AND CONTROL FOR ADAPTABLE USE

BACKGROUND OF THE DISCLOSURE

The present disclosure generally relates to a cooking burner, and more specifically, to a burner with a single outer profile defining extension sections extending from between two concentric arced segments and features for optimizing the performance thereof.

Various burner constructions have been developed to provide versatile arrangements for heating a variety of different cooking implements. In one aspect, various elongated burners have been used to heat elongated items. In some implementations, such burners are provided in overlapped arrangements with a more conventional, round central burner with smaller extensions extending outwardly from beneath the fuel outlets on the central burner. Such overlapped structures provide complexities in their use and limitations in performance.

SUMMARY OF THE DISCLOSURE

According to one aspect of the present disclosure, a cooking burner includes a spreader defining a first side wall defining an outer profile having first and second extension sections opposed about a first axis, each having a semi-circular end segment with first and second parallel straight segments extending parallel with the first axis from opposite ends of the semi-circular segment. The spreader further defines first and second arced sections, each extending outwardly along a second axis perpendicular to the first axis from and between the first parallel straight segments and second parallel straight segments of the first and second extension sections, respectively. The spreader further defines a second side wall defining a circular profile disposed inwardly of and concentric with the first and second arced sections and a plurality of fuel outlets extending through both the first side wall and the second side wall. A circular inner cap is assembled with an upper portion of the circular inner profile, an annular outer cap is assembled with respective upper portions of the first and second arced sections, and first and second extension caps assembled with respective upper portions of the first and second extension sections.

According to another aspect of the present disclosure, a cooking hob includes an upper cooktop surface and a burner unit supported along a portion of the cooktop surface. The burner unit includes a spreader defining a first side wall defining an outer profile having first and second extension sections opposed about a first axis, each having a semi-circular end segment with first and second parallel straight segments extending parallel with the first axis from opposite ends of the semi-circular segment. The spreader further defines first and second arced sections, each extending outwardly along a second axis perpendicular to the first axis from and between the first parallel straight segments and second parallel straight segments of the first and second extension sections, respectively. The spreader further defines a second side wall defining a circular profile disposed inwardly of and concentric with the first and second arced sections and a plurality of fuel outlets extending through both the first side wall and the second side wall. A circular inner cap is assembled with an upper portion of the circular inner profile, an annular outer cap is assembled with respective upper portions of the first and second arced sections, and first and second extension caps assembled with respective upper portions of the first and second extension sections.

According to yet another aspect of the present disclosure, a method for controlling a cooking burner includes positioning a bidirectional valve coupled with the first, second, third, and fourth fuel supply lines in a central position in which the valve is closed with respect to the first, second, third, and fourth fuel supply lines, thereby maintaining the burner in an off condition and moving the bidirectional valve into a first range of movement to adjust a flow of fuel to the fourth fuel supply line while remaining closed with respect to the first, second, and third fuel supply lines to control the flow of fuel to a circular profile disposed inwardly of and concentric with first and second arced sections, while maintaining a flow of fuel to first and second extension sections of the burner that are opposed about a first axis and the first and second arced sections, which extend outwardly along a second axis perpendicular to the first axis from and between the first and second extension sections, in an off condition. The method further includes moving the bidirectional valve into a second range of movement adjusting the flow of fuel to the first, second, and third fuel supply lines simultaneously to control the flow of fuel to the first and second extension sections, the first and second arced sections. In some aspects, the circular profile may be controlled separately from the remaining sections or simultaneously therewith.

These and other features, advantages, and objects of the present disclosure will be further understood and appreciated by those skilled in the art by reference to the following specification, claims, and appended drawings.

Figure 1:
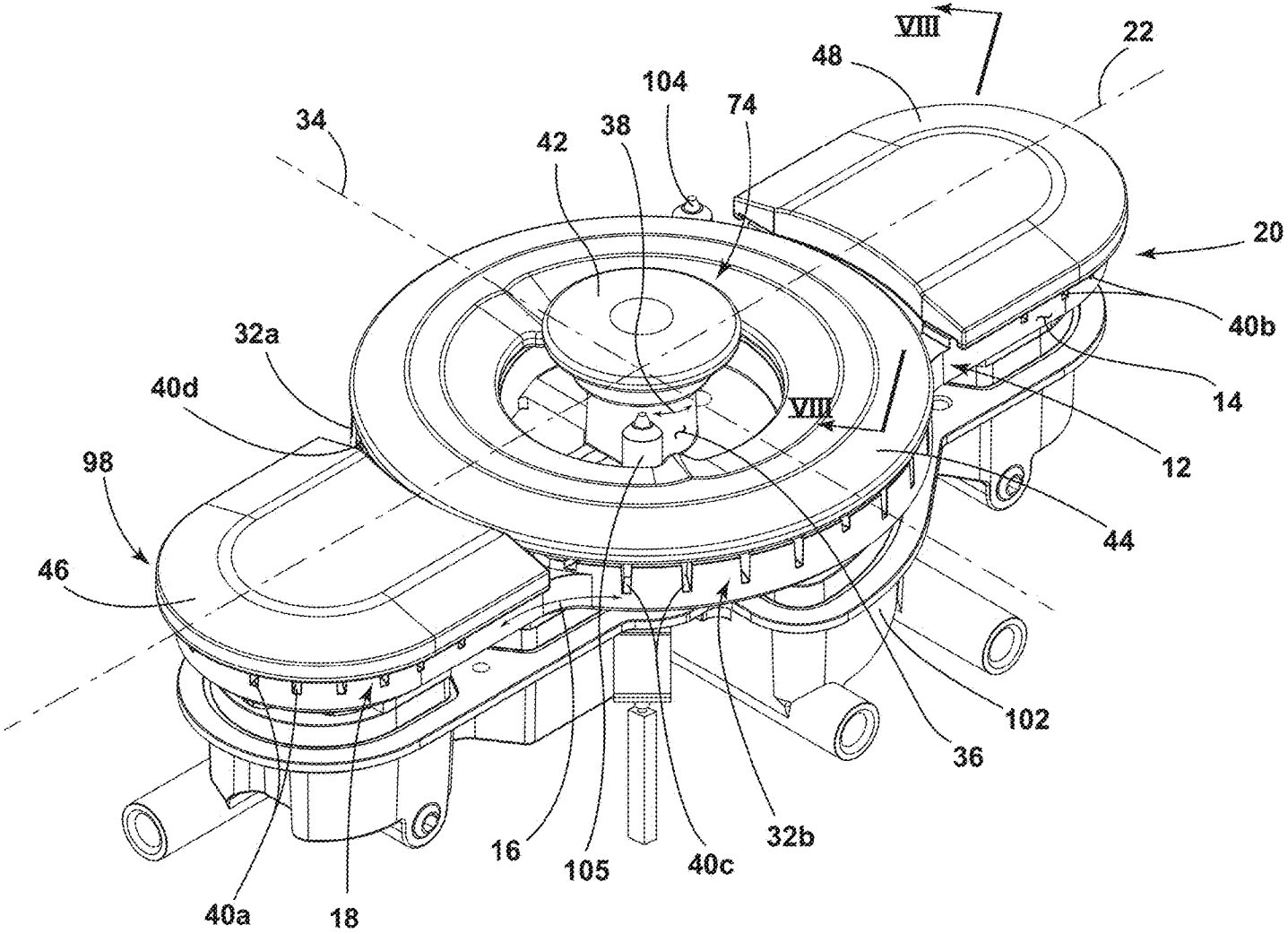
FIG. 1 is a perspective view of a burner unit according to an aspect of the disclosure.

The components in the figures are not necessarily to scale, emphasis instead being placed upon illustrating the principles described herein.

DETAILED DESCRIPTION

The present illustrated embodiments reside primarily in combinations of method steps and apparatus components related to a cooking burner. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-10, reference numeral 10 generally designates a cooking burner. The cooking burner 10 includes a spreader 12 having a first side wall 14 defining an outer profile 16 having first and second extension sections 18 and 20 opposed about a first axis 22. Each of the extension sections 18, 20 has a semi-circular end segment 24 and 26, respectively, with first and second parallel straight segments 28*a*, 28*b*, and 30*a*, 30*b*, respectively, extending parallel with the first axis 22 from opposite ends of the respective end segment 24, 26. The first side 14 wall further defines first and second arced sections 32*a*, 32*b*. Each arced section 32*a*, 32*b* extends outwardly along a second axis 34 perpendicular to the first axis 22 from and between the first parallel straight segments 28*a*, 28*b* and second parallel straight segments 30*a*, 30*b* of the first and second extension sections 24, 26, respectively. The spreader 12 further has a second side wall 36 defining a circular profile 38 disposed inwardly of and concentric with the first and second arced sections 32*a*, 32*b*. A plurality of fuel outlets (designated generally as 40 and with further specificity, as applicable, below) extending through both the first side wall 14 and the second side wall 36. The cooking burner 10 further includes a circular inner cap 42 assembled with an upper portion of the second side wall 36, an annular outer cap 44 assembled with respective upper portions of the first and second arced sections 32*a*, 32*b*, and first and second extension caps 46, 48 assembled with respective upper portions of the first and second extension sections 18, 20.

Figure 3:
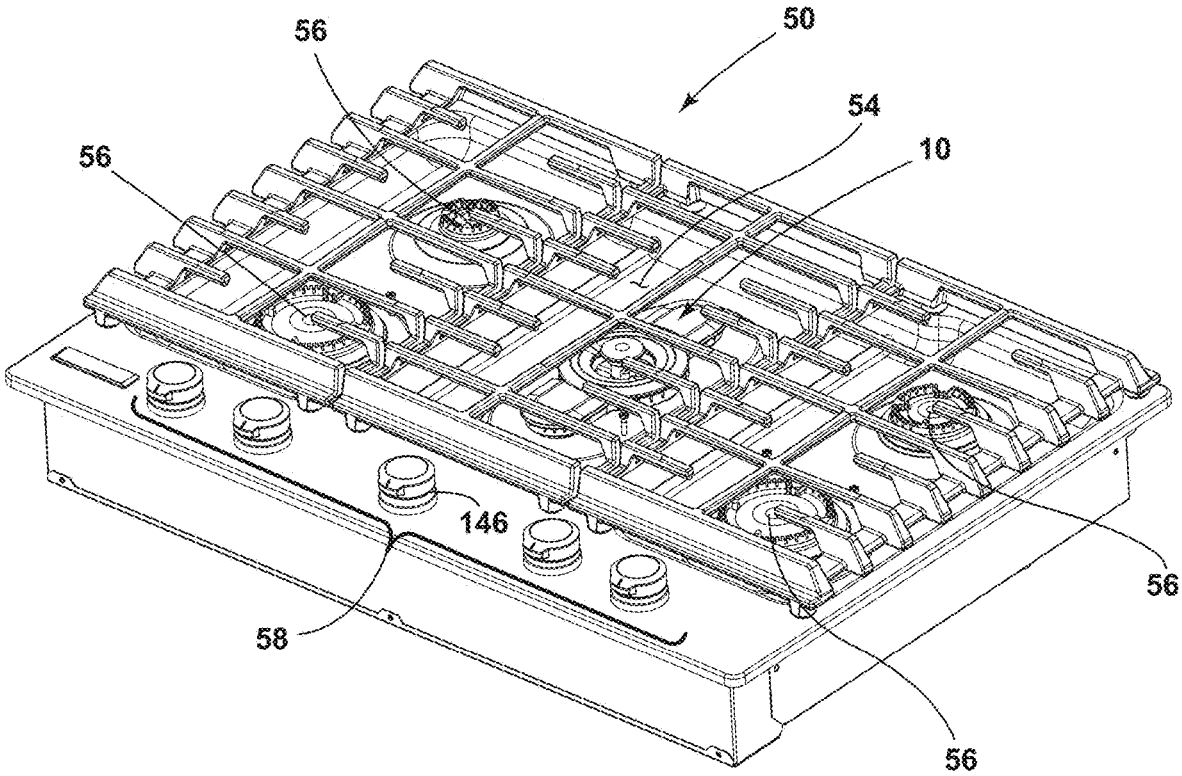
FIG. 3 is a perspective view of a cooking appliance including a burner according to FIG. 1.

As shown in FIG. 3, the above-described cooking burner 10 can be used in connection with a cooking hob 50. In the illustrated example, the cooking hob 50 is included a stand-alone cooking appliance 52. In other examples, the cooking hob 50 can be included in as a range that includes an oven in addition to the hob 50 in which burner 10 is included, or can be incorporated into other appliance variations. As shown, the cooking burner 10 is supported on an upper surface 54 of the cooking hob 50 that can be of stamped sheet metal (e.g., stainless steel) or the like. In various implementations, the cooking burner 10 can be partially supported on the outer portion of upper surface 54 (e.g., with spreader 12 at least partially supported on upper surface 54), can be mounted on the interior of upper surface 54 by way of an additional component or structure of burner 10, as discussed further below, or combinations thereof. As further shown, cooking hob 50 can include a number of additional burners 56*a*-56*d* in an arrangement that includes cooking burner 10 and is configured to provide a variety of cooking locations in a configuration facilitating general usability of cooking hob 50 in across a plurality of settings. In the illustrated example, the present cooking burner 10 is centrally disposed along upper surface 54 between the additional burners 56*a*-56*d*, although other arrangements are possible. Cooking hob 50 includes a plurality of controls 58 for the cooking burners 10 and 56*a*-56*d*, as well as other functionality of the appliance 52.

Figure 2:
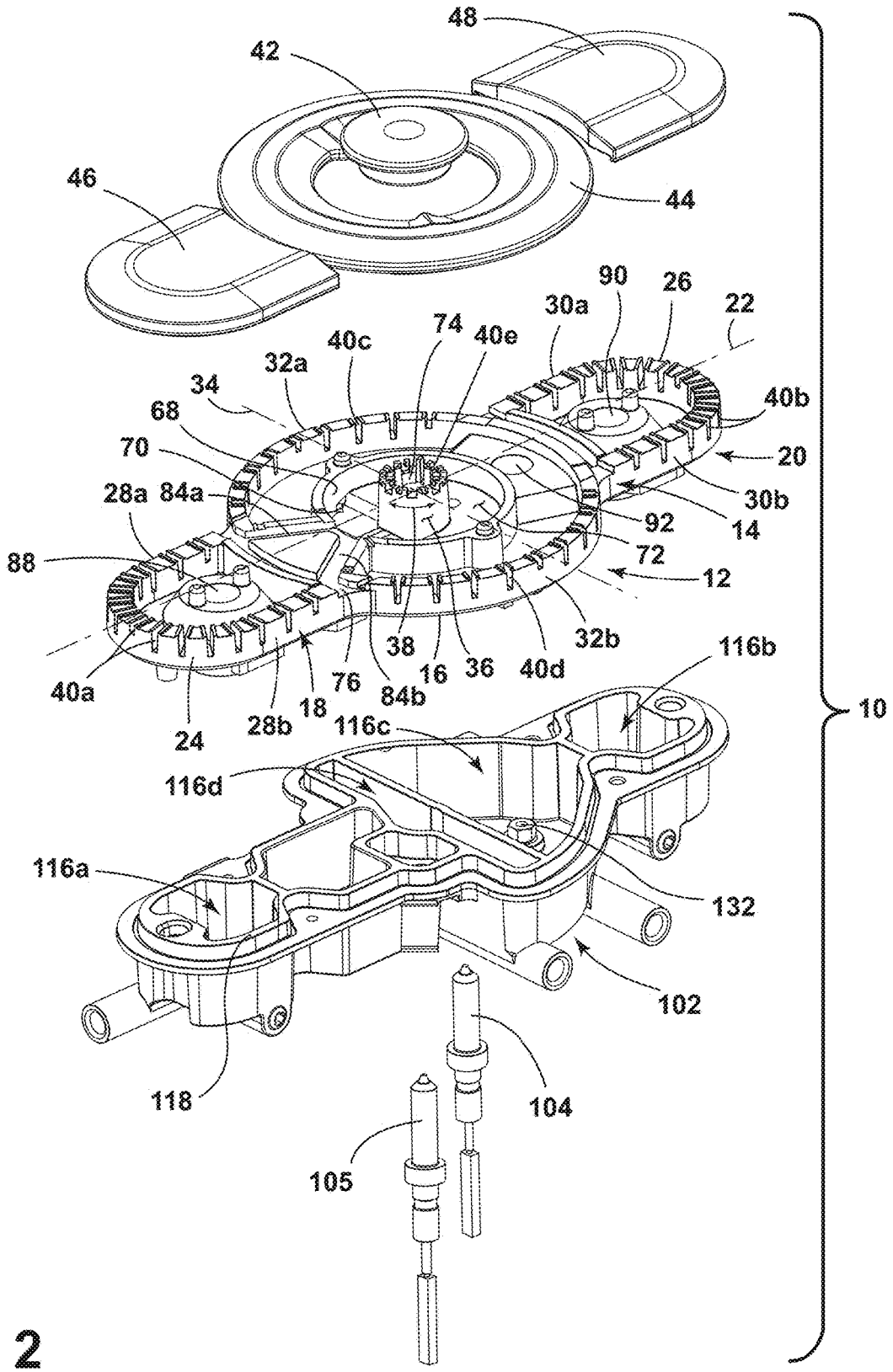
FIG. 2 is an exploded perspective view of the burner unit of FIG. 1.
Figure 4:
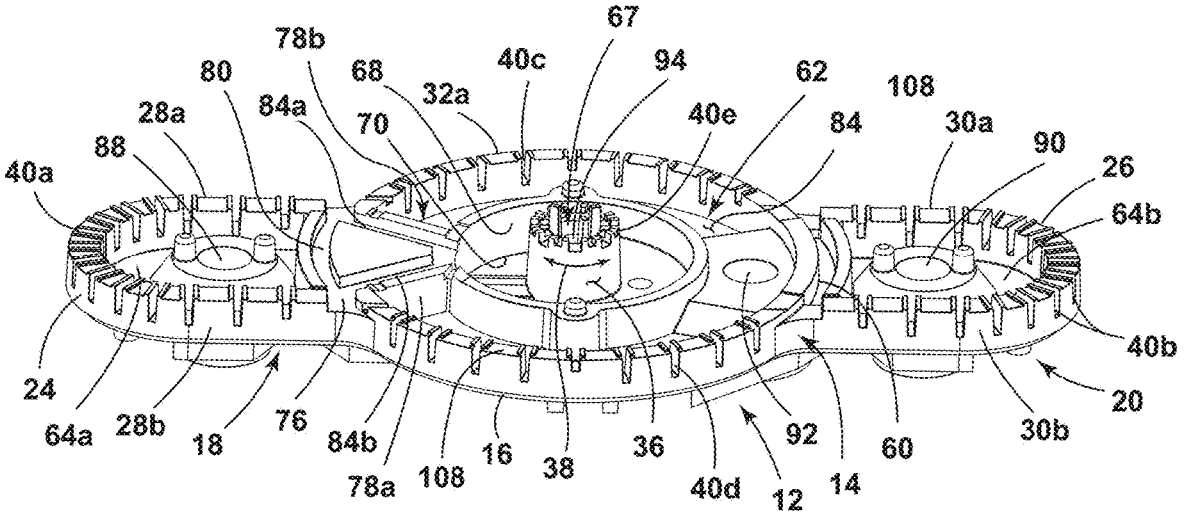
FIG. 4 is a perspective view of a spreader used in the burner of FIG. 1.
Figure 5:
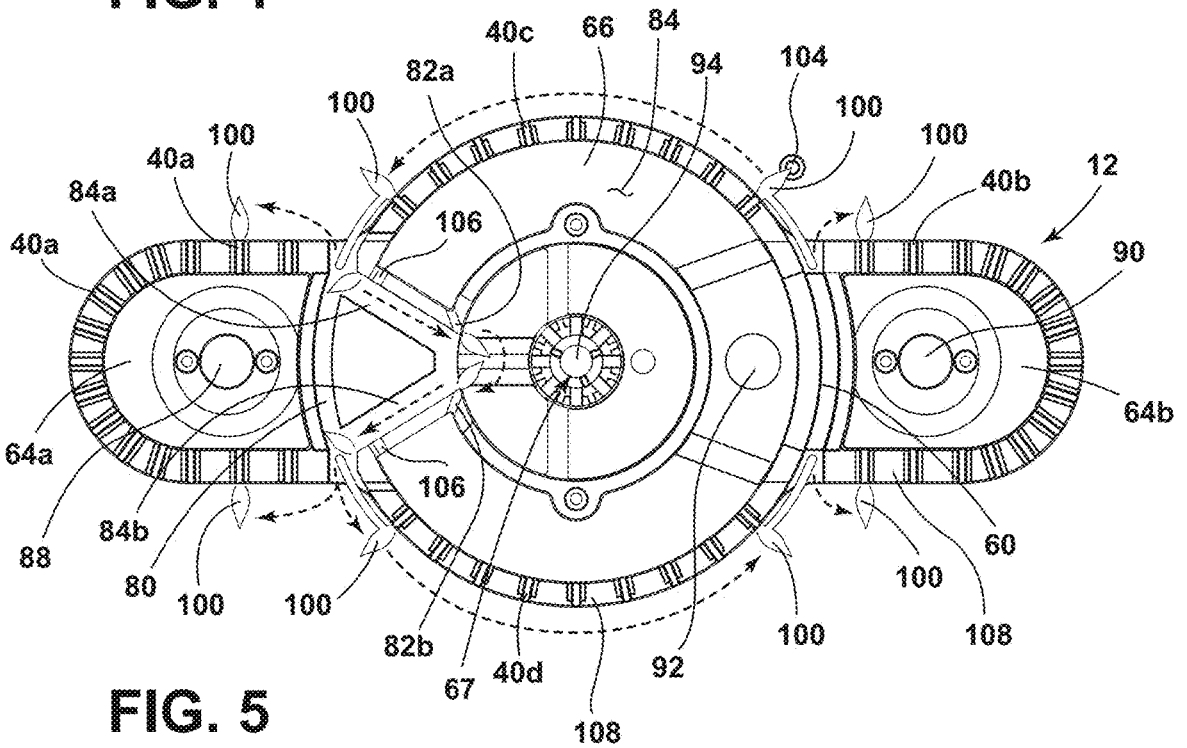
FIG. 5 is a top view of the spreader of FIG. 4.

Turning now to FIGS. 4 and 5 (with continued reference to FIG. 2), the spreader 12 defines an interior wall segment 60 that separates an interior 62 of the spreader 12 into a first extension fuel mixing chamber 64*a* and an outer circular fuel mixing chamber 66. As shown, the first extension fuel mixing chamber 64*a* is defined in a portion of the interior 62 that is within (or bounded by) the portion of the first side wall 14 that defines the first extension section 18 of the outer profile 16. The outer circular fuel mixing chamber 66 is similarly defined in another portion of the interior 62 that is within the portion of the first side wall 14 that defines the first and second arced sections 32*a* and 32*b*. As further shown, the spreader also defines a third side wall 68 that defines an interior profile 70 that further encloses the outer circular fuel mixing chamber 66 and separates the interior 62 of the spreader 12 from an inner open section 72 of the spreader 12. As shown in FIGS. 1 and 2, the inner open section 72 is centrally-disposed within the outer circular fuel mixing chamber 66 and is concentric with the first and second arced sections 32*a*, 32*b* and is uncovered between the outer annular cap 44 and the inner cap 42. As discussed above, the inner cap 42 is supported by and encloses an upper portion of the second side wall 36 to define an inner simmer burner of the burner unit 10 that projects from the inner open section 72.

The spreader 12 also includes an inner channel wall segment 76 that is defined by a raised section of the spreader 12 that extends from the third side wall 68 (i.e. adjacent to the inner open section 72) toward the first side wall 14. As shown in FIGS. 4 and 5, the inner channel wall segment defines an interruption within the outer fuel mixing chamber along the portion thereof that is aligned with second extension section 18 (i.e. between adjacent ends of the arced sections 32*a*,32*b*). In particular, the channel wall segment 76 includes opposite interior faces 78*a* and 78*b* that define portions of the outer fuel mixing chamber 66. In the illustrated example, the interior faces 78*a*, 78*b* are inwardly tapered from adjacent the first side wall 14 to adjacent the third side wall 68. Within the channel wall segment is defined a carryover channel 80 that extends from the intersection of the second straight segment 30*a* and the adjacent first arced section 32*a* and the opposite intersection of the opposite second straight segment 30*b* and the adjacent second arced section 32*b*. The carryover channel 80 is further open through the third side wall into the inner open area where pilot ports 82*a* and 82*b* are positioned and extend through third side wall 68 between outer fuel mixing chamber 66 and inner open section 72. The channel wall segment 76 also encloses a portion of the interior 62 of spreader 12 within the second extension section 20 to define a second extension mixing chamber 64*b*.

The spreader 12 includes a lower wall 84 defining a lower outside surface 86. In this manner spreader 12 is configured such that the first side wall 14 extends in from lower wall 84 in a direction generally perpendicular to the lower surface 86. Respective portions of the lower wall 84 enclose portions of the outer interior mixing chamber 66 and the first and second extension mixing chambers 64*a*, 64*b* opposite the associated caps 42, 46, and 48. First and second venturi outlets 88 and 90 are defined through the lower wall 84 of the spreader 12 and are respectively open to the first and second extension mixing chambers 64*a* and 64*b*. As discussed further below, fuel and air are provided to the first and second extension mixing chambers 64*a* and 64*b* through the first and second venturi outlets 88 and 90, respectively for mixing within the chamber 64*a* and 64*b* before escaping through the fuel outlets 40*a* and 40*b* that extend through the first side wall 14 within portions of the outer profile 16 associated with the first and second extension sections 18 and 20. Similarly, a third fuel inlet port 92 can extend through the lower wall 84 of spreader 12 within the outer circular fuel mixing chamber 66 to provide fuel and air thereto for mixing within the chamber 66 before escaping through the fuel outlets 40*c* and 40*d* that extend through the first side wall 14 within portions of the outer profile 16 associated with the first and second arced sections 32*a* and 32*b*. A further inlet port 94 is provided in connection with the simmer burner 74 outlets 40*e*. In this manner, a flow of fuel 96 is provided to the various fuel outlets 40*e* within simmer burner 74 and the remaining fuel outlets 40*a*-40*d* within a single outer burner 98 that collectively extends through the end segments 24 and 26 and through the two arced sections 32*a* and 32*b*. The fuel flows may be separately provided to the respective burners 74 and 98 and ignited to produce separate associated flames 100 corresponding with the groups of fuel outlets 40*a*-40*d* and 40*e*.

The fuel outlets within the outer profile 16 are arranged to provide a consistent flame profile for the outer burner 98, including without any such flames 100 overlapping at the intersections between the straight segments 28*a*, 28*b*, 30*a*, 30*b* with the arced sections 32*a* and 32*b* (where a pronounced inner corner may be formed). Further, the first side wall 14 defines an upper surface 108 along the outer profile 16. As shown, the upper surface 108 is disposed at a consistent height above the lower surface 86 of the spreader 12 through the first and second extension sections 18 and 20 and the first and second arced sections 32*a* and 32*b*. In this manner, all of the fuel outlets 40*a*-40*d* associated with the outer burner 98 are generally vertically aligned. Accordingly, the corresponding ones of the fuel outlets 40*a*, 40*b*, 40*c*, and 40*d* may be spaced apart by a distance such that ignition of the fuel flow 96 from one outlet (e.g. 40*c*) may not cause ignition of the next adjacent outlet (e.g., 40*d*). With continued reference to FIG. 5, the above-described carryover channels 80*a* and 80*b*, accordingly, are provided to promote the carryover of ignition between arced sections 32*a* and 32*b* and between arced section 32*a* and second extension section 20.

The cooking burner 10 further includes a holder 102 supporting the spreader 12 as well as an ignition electrode 104. In the illustrated example, the ignition electrode 104 is positioned at an intersection of the first arced section 32*a* and the second extension section 20. The ignition electrode 104 activates to cause ignition of the fuel-air mixture flowing through adjacent ones of the fuel outlets 40*c* within the first arced section 32*a* and of the fuel outlets 40*a* within the first extension section 18 and fuel outlets 40*b* within the second extension section 20. This arrangement allows for ignition of flames 100 around the first arced with the carryover channel promoting ignition of the fuel outlets 40*d* within the second arced section 32*b* by igniting the flow of fuel 96 entering the carryover channels 80*a* and 80*b* via pilot fuel outlets 106 positioned along the channels 80*a* and 80*b*. Alternative ignition of the fuel flow within carryover channels 80*a* and 80*b* can also promote ignition of the fuel emanating from the fuel outlets 40*b* within the second extension section 20 in a similar manner.

Figure 6:
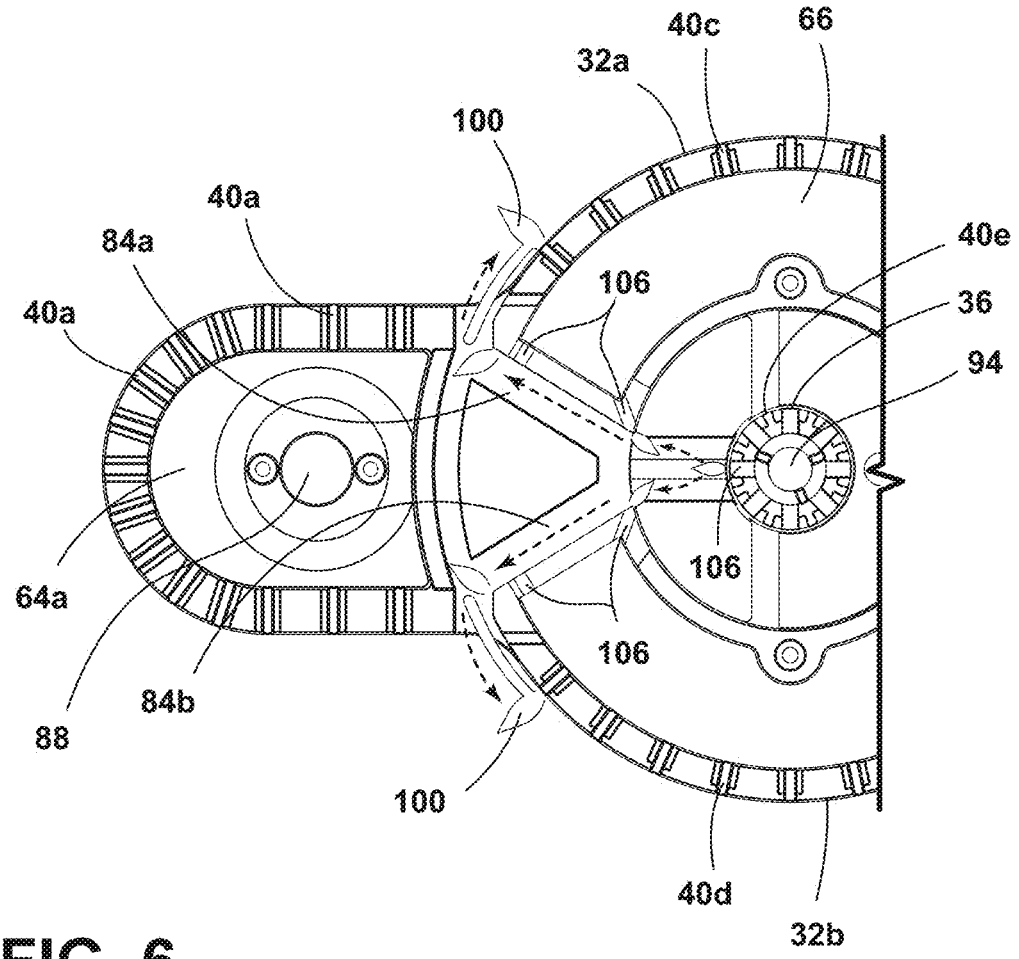
FIG. 6 is a detail view of the spreader of FIG. 4.

In an alternative arrangement shown in FIG. 6, another ignition electrode 105 can be positioned within the inner open section 72 to ignite the simmer burner 74. The simmer burner 74 can include an additional pilot flame outlet 106 positioned below the other fuel outlets 40*e* included on the second side wall 36 and generally directed at the intersection between the carryover channels 80*a* and 80*b* that is exposed along the interior wall segment 60. In this manner, the ignition of the simmer burner 74 can cause ignition of the outer burner 98 once fuel 96 is provided thereto (i.e., by introducing fuel from the outlets 90, 92, and 94 associated therewith) by igniting a portion of the flow of fuel 96 within carryover channels 80*a* and 80*b*.

Figure 7:
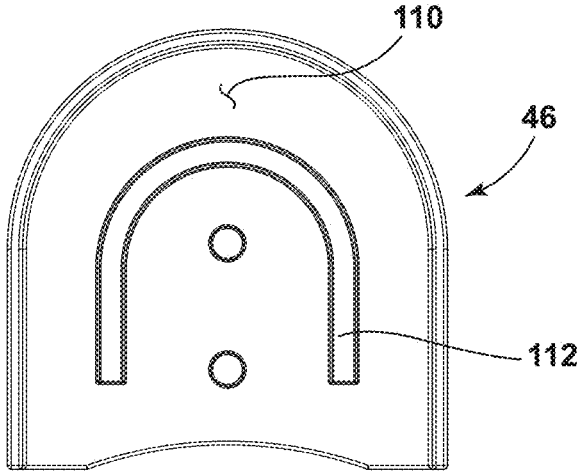
FIG. 7 is a detail view of a portion of a cap used to enclose a cavity within an extension section of the burner of FIG. 1.
Figure 8:
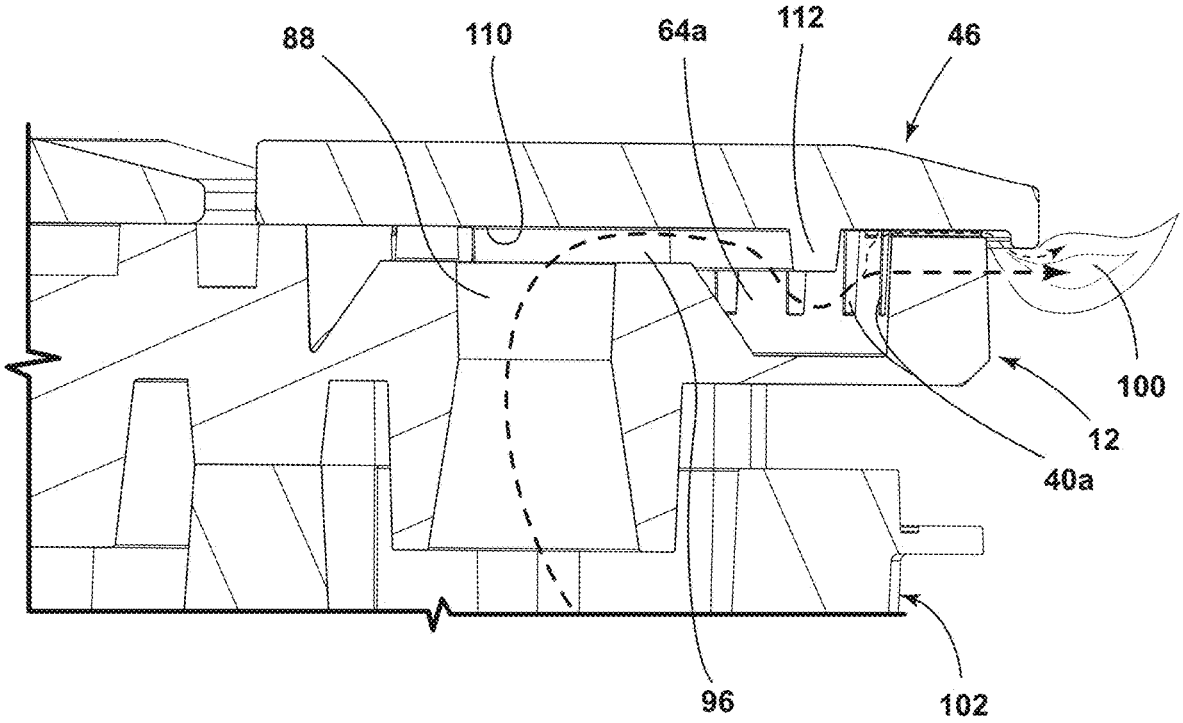
FIG. 8 is a cross-section view of a portion of the burner unit.

As generally shown in FIGS. 4 and 5, the fuel outlets 40*a*-40*d* that extend through the first side wall 14 along the outer profile 16 also extend through and are open on the upper surface 108 of the first side wall 14. Turning now to FIGS. 7 and 8, the first and second extension caps 46 and 48 each define a lower inside surface 110 that encloses the fuel outlets 40*a* and 40*b* at the upper surface 108 of the first side wall 14 within the first and second extension sections 18 and 20. The above-described annular outer cap 44 similarly encloses the fuel outlets 40*c* and 40*d* at the upper surface 108 of the first side wall 14 within the first and second arced sections 32*a* and 32*b*. In certain embodiments of the spreader 12 described herein, the size of the extension fuel mixing chambers 64*a* and 64*b* in relation to the size of the first and second venturi outlets 88 and 90 and/or the fuel outlets 40*a* and 40*b*, as well as the amount of fuel flow 96 intended to be delivered through venturi outlets 88 and 90 and out of the fuel outlets 40*a* and 40*b*, can cause situations where some of the flames 100 emanating from extension sections 18 and 20 may "lift" out of the outlets and emanate from any gaps between the upper surface 108 of the first side wall 14 and the lower surface 110 of the extension caps 46 and 48. To prevent such lift from occurring, the extension caps 46 and 48 can each include an interior diverter ridge 112 that extends downwardly from the lower inside surfaces 110 of the extension caps 46 and 48 at respective positions disposed inwardly of the interior of the first side wall 14. As shown in FIG. 8, the diverter ridges 112 can partially overlap with the fuel outlets 40*a* and 40*b* to divert the flow of fuel 96 downward to ensure movement thereof through fuel outlets 40*a* and 40*b* and to significantly reduce any lifting effect. Further, the overlap between the diverter ridges 112 and the fuel outlets 40*a* and 40*b*, may only be partial (e.g., through between 40% and 60% of the height thereof) to maintain a sufficiently smooth flow of fuel 96 out of fuel outlets without introducing excessive turbulence or slowing the flow of fuel by an undesirable amount. Similar additional diverter ridges may be incorporated along the lower inside surface of the inner cap 42 in a similar positioning with respect to the fuel outlet ports 40*c* and 40*d* within the arced sections 32*a* and 32*b*.

Figure 9:
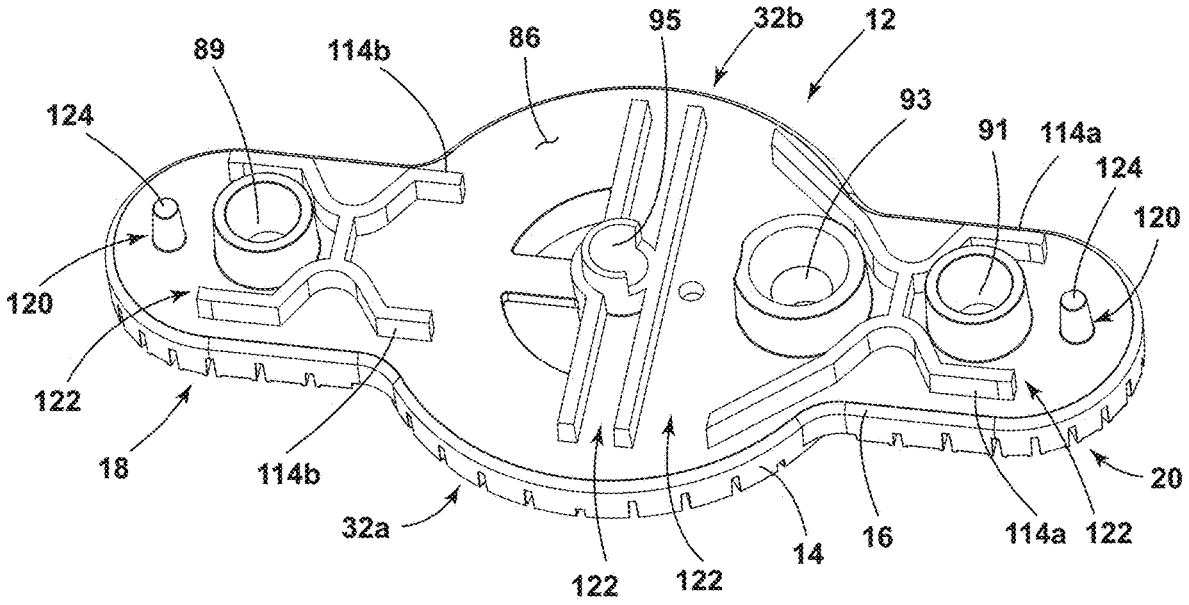
FIG. 9 is a perspective view of an underside of the spreader.
Figure 10:
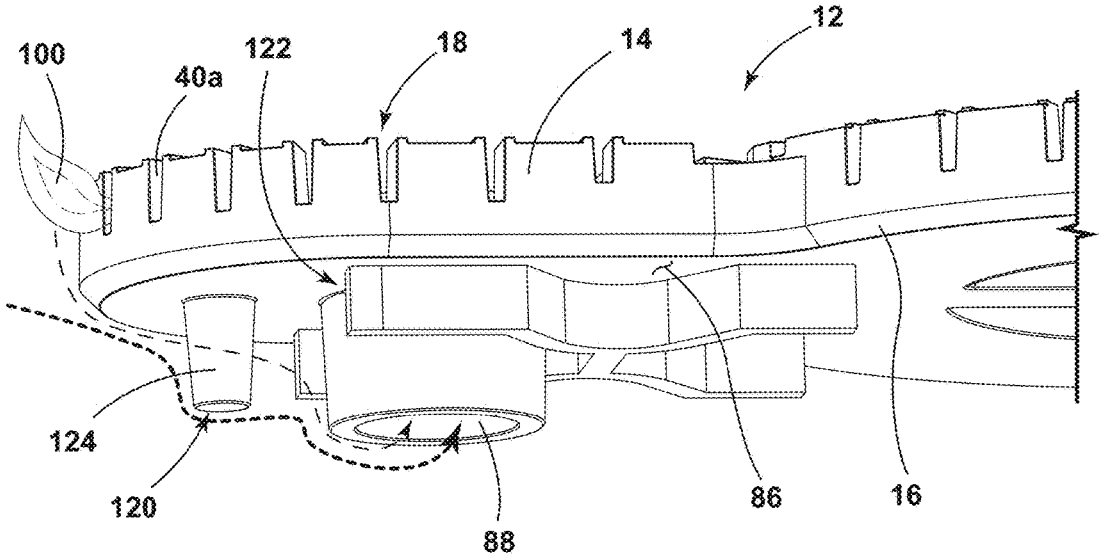
FIG. 10 is a further perspective view of the underside of the spreader.

Turning now to FIGS. 9 and 10, the above mentioned holder 102 (further shown in FIGS. 1 and 2, defines an interior fuel distribution chamber 116 and supports the spreader 12 in a position where the various venturi outlets 88, 90, 92, and 94 to the interior 62 (FIG. 4) of spreader 12 are in fluid communication with the interior fuel distribution chamber 116. In this manner, the lower surface 86 of the spreader 12 is spaced from an upper edge 118 of the holder to define an air inflow path 120 through a portion of the fuel distribution chamber 116 and into the venturi outlets 88, 90, 92, and 94 to enter the associated fuel mixing chambers 64*a*, 64*b*, 66, and 67 to mix with the fuel for combustion by the burners sections. In various implementations of the burner 10, including of the spreader 12 described herein, the amount of air drawn in through the inflow path 120 in comparison with the dimensions of the extension sections 18 and 20, as well as the proximity of the venturi outlets 88 and 90 to the outer profile 16 of the first side wall 14, can create a high velocity of the air within the inflow path 120. This high inward flow 120 of air entering the interior distribution chamber 116 just below the location of the outward fuel flow 96 can cause a pressure drop beneath fuel outlets 40*a*, 40*b*, 40*c*, and 40*d* that causes a downward "drag" on the fuel flow 96 and, thusly, on the flames 100 emanating from fuel outlets 40*a*, 40*b*, 40*c*, and 40*d*. This drag can cause degradation of the quality of the flames 100 and can contribute to a characteristic "pop" sound during flame 100 ignition.

To reduce the drag effect of the air inflow 120 on the flames 100 and fuel flow 96, spreader 12 can include a plurality of lower ribs 114 that extend from the lower surface 86 of spreader 12 in a downward direction (i.e., opposite the first side wall 14). As shown in FIG. 10, the presence of the lower ribs 114 can direct the air inflow 120 downward and away from the flames 100 above such air inflow 120. The lower ribs 114 can also slow the air inflow 120, thereby reducing the overall pressure drop caused thereby. Both of these effects can lower the drag of the air inflow 120 on flames 100. As also shown in FIG. 9, at least one of the lower ribs 114*a* generally surrounds and is spaced apart from the second venturi inlet 91. As the second venturi inlet 91 is positioned proximate the outer venturi inlet 93, the lower rib 114*a* can also partially surround the outer venturi inlet 93. In particular, the shape of lower rib 114*a* can be such that it forms a partial barrier between venturi inlet 91 and the intersection of lower surface 86 and first side wall 14, as well as a similar partial barrier between outer venturi inlet 93 and the corresponding intersection of lower surface 86 and first side wall 14 along a portion thereof where the first side wall 14 is within a predetermined distance (e.g. 1.5 cm to 2 cm) of the outer venturi inlet port 93. As further shown, the lower rib 114*a* can include various interruptions 122 therein to allow for increased quantity of air inflow 120, for example, in areas laterally between fuel outlets 40*a*. The interruptions 122 can also be positioned to accommodate various alignment features 124 used to properly position spreader 12 on holder 102. In a similar manner, another lower rib 114*b* surrounds and is spaced apart from the first venturi inlet 89. Lower rib 114*b* may be similarly specifically structured to extend downward past the upper edge 118 of the holder 102 and partially into the fuel distribution chamber 116 to deflect a portion of the air inflow 120 path away from the openings 40*b* and to slow the rate of such air inflow 120. The structure of rib 114*b* may be derived to allow sufficient inflow 120 to central venturi inlet 95, which includes fuel outlets 40*e* sufficiently spaced from the outer profile 116 to diminish any potential drag. Similar to lower rib 114*a*, the lower rib 114*b* surrounding the first extension venturi inlet 89 may include interruptions 122 to strategically maintain the quantity of air inflow 120 to inlet 89 and to accommodate a similar alignment feature 124.

Figure 11:
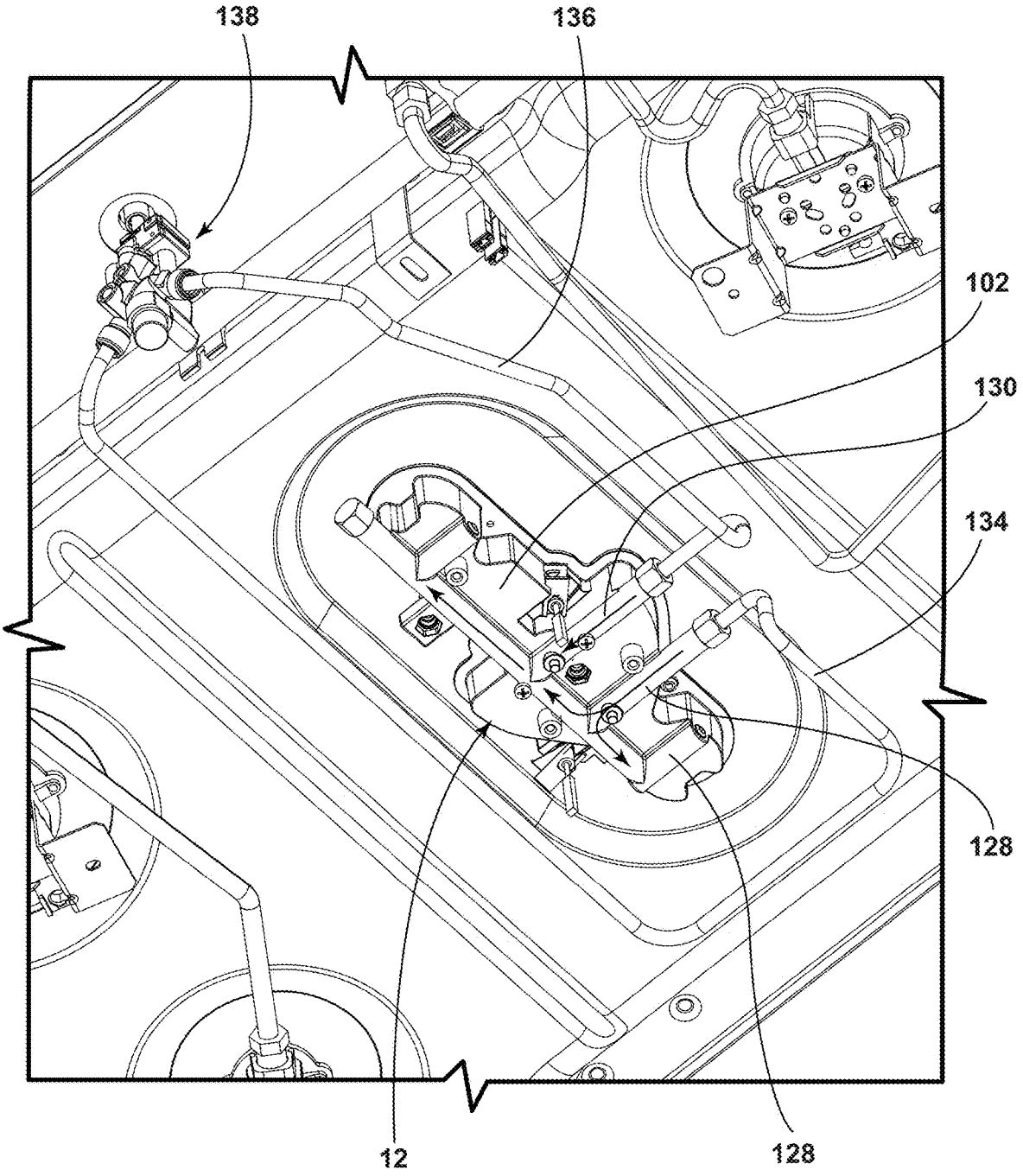
FIG. 11 is a perspective view of the burner unit of FIG. 1 showing fuel supply lines associated therewith in one implementation.
Figure 12:
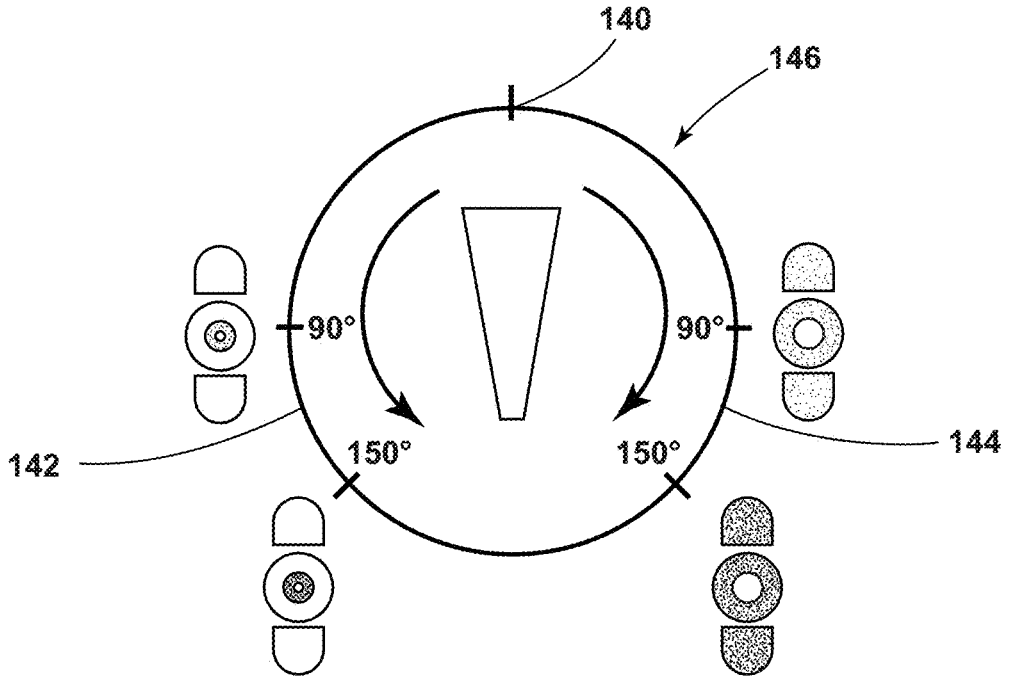
FIG. 12 is a schematic view illustrating a control scheme useable with the fuel supply line configuration of FIG. 11.

Turning now to FIGS. 11 and 12, cooking hob 50 includes first and second fuel supply lines 134 and 136 connecting with burner 10. The first fuel supply line 134 is respectively associated with the first and second extension sections 18 and 20 for providing fuel (such as natural gas, propane, or the like) to the fuel distribution chambers 116*a* and 116*b* at spuds 132 that are respectively aligned with the first and second venturi outlets 88 and 90 to the first and second fuel mixing chambers 64*a* and 64*b*. The first fuel supply line 134 is further associated with the first and second arced segments 32*a* and 32*b*, in particular by providing fuel to the fuel distribution chamber 116*c* an additional spud 132 that is aligned with the outer venturi outlet 92 within the outer circular mixing chamber 66. Similarly, the second fuel supply line 136 is associated with the simmer burner 74 by providing fuel to an additional fuel distribution chamber 116*d* positioned beneath and in communication with central inlet port 94. In an embodiment, the first and second fuel supply lines 134 and 136 can connect with fuel distribution segments 128 and 130 that are integrally formed with the holder 102 such that first fuel supply line 134 can connect to holder 102 for supplying fuel to the extension sections 18 and 20, along with the first and second arced segments 32*a* and 32*b*. In this manner, the first supply line 134 provides fuel from a central manifold of the associated appliance 52 for appropriate distribution throughout the entire outer burner 98. Second supply line 136 attaches with distribution segment 130 to supply fuel to the simmer burner 74 separately from the outer burner 98.

Figure 13:
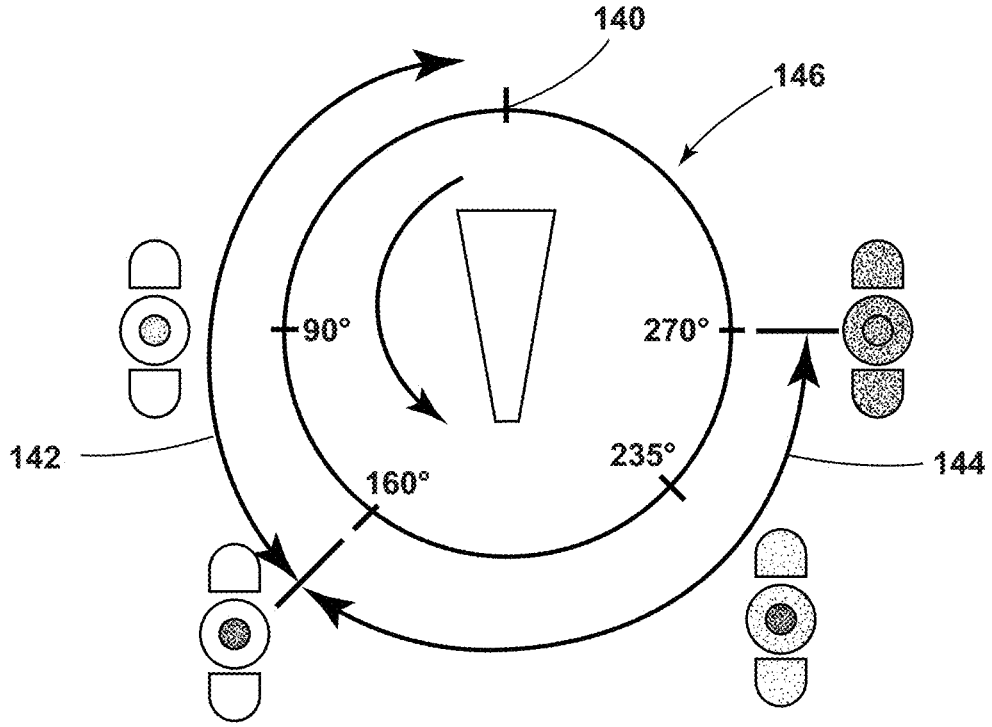
FIG. 13 is a schematic view illustrating an alternative control scheme useable with the fuel supply line configuration of FIG. 11.

As shown in FIG. 12, a multi-directional valve may be included with the appliance 52 in which the burner unit 10 is included for control of the burner unit 10, as described above. The valve 138 is coupled with the first and second fuel supply lines 134 and 136. In this manner, the valve 138 can be configured to be moveable from a central position 140 in which the valve 138 is closed with respect to the first fuel supply line 134 (and, accordingly, the first, second, and third fuel distribution segments 126, 128, and 130) into a first range of movement 142 in which valve 138 adjusts the flow of fuel to the second fuel supply line 136, while remaining closed with respect to the first fuel supply line 134. Accordingly, the valve 138, when turned through the first range of movement 142 controls the output of simmer burner 74 alone, with the outer burner 98 remaining off. Valve 138 is further moveable into and within a second range of movement 144 wherein the valve 138 adjusts the flow of fuel to first fuel supply line 134 alone. In this range of movement 142, the outer burner 98 is controlled with simmer burner 74 remaining off. In an alternative arrangement, shown in FIG. 13, the valve 138 may be a two-stage valve, wherein the above-described first and second ranges of motion are successive, such that at the end of the first range of motion 142, wherein only the simmer burner 74 is active, the valve may be turned into the second range of motion 144, wherein the simmer burner 74 is active at its highest output rate, while the outer burner 98 is also activated at its highest output. Continued turning through the second range or motion 144, adjusts the flow rate to both the simmer burner 74 and the outer burner 98 downward.

In one aspect of the disclosure, a method for controlling the cooking burner 10, described above, with the bidirectional valve 138 includes positioning the knob 146 used to control the valve 132 in the central position 140 to maintain the entire burner unit 10 (including the outer burner 98 and simmer burner 74) in an off condition. The method further includes moving the valve 138 into the first range of movement 142 to adjust the flow of fuel to the second fuel supply line 136, thusly using and controlling the simmer burner 74 output, while maintaining the outer burner 98 in the off condition. Moving the valve 138 into the second range of movement 144 adjusts the flow of fuel to the first fuel supply line 134 only while maintaining the second fuel supply line 136 closed to control the flow of fuel to the outer burner 98 (i.e. the combined first and second extension sections 18 and 20, the first and second arced sections 32*a* and 32*b*) only with the simmer burner 74 remaining off.

Figure 14:
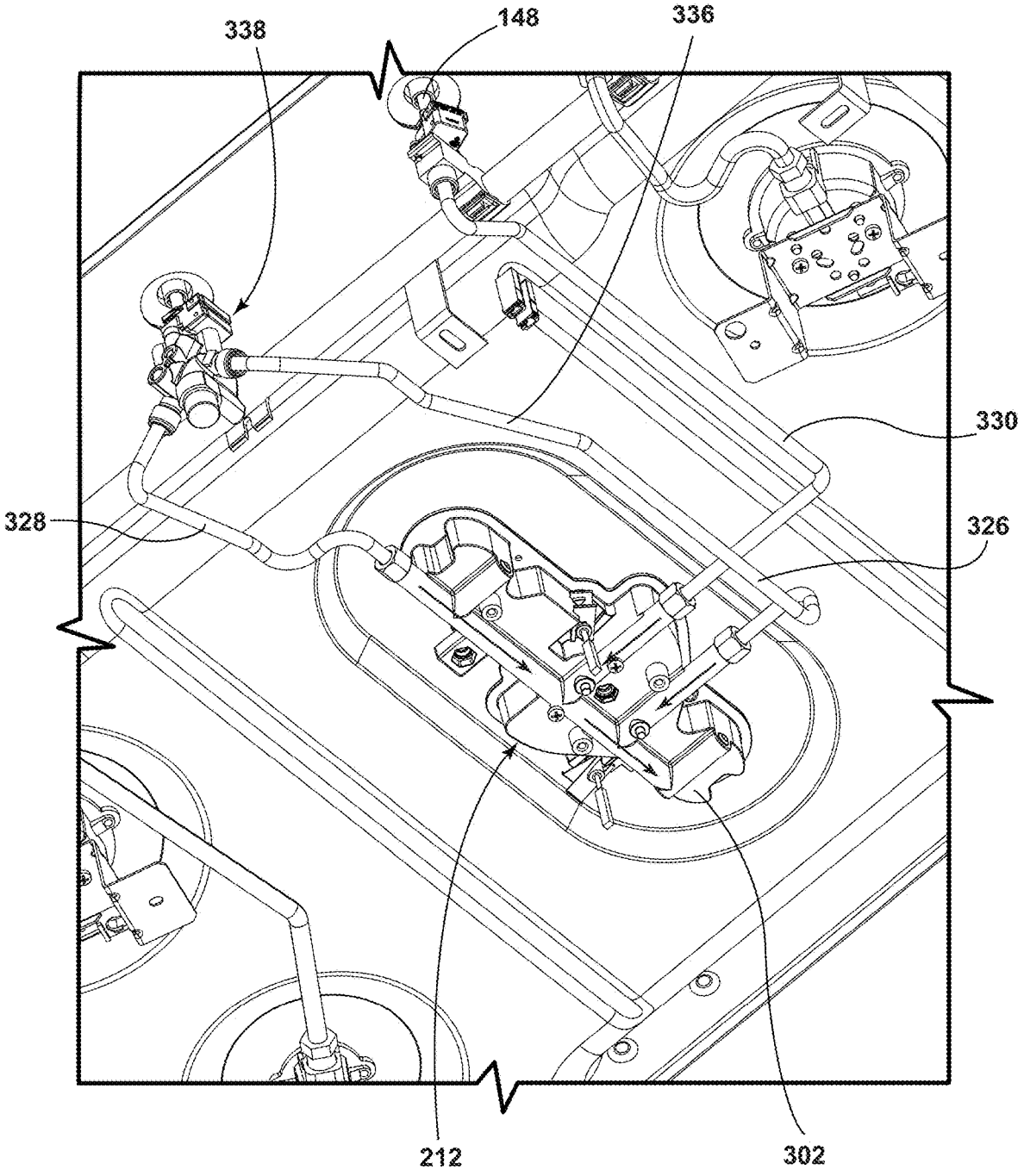
FIG. 14 is a perspective view of the burner unit of FIG. 1 showing fuel supply lines associated therewith in another implementation.
Figure 15:
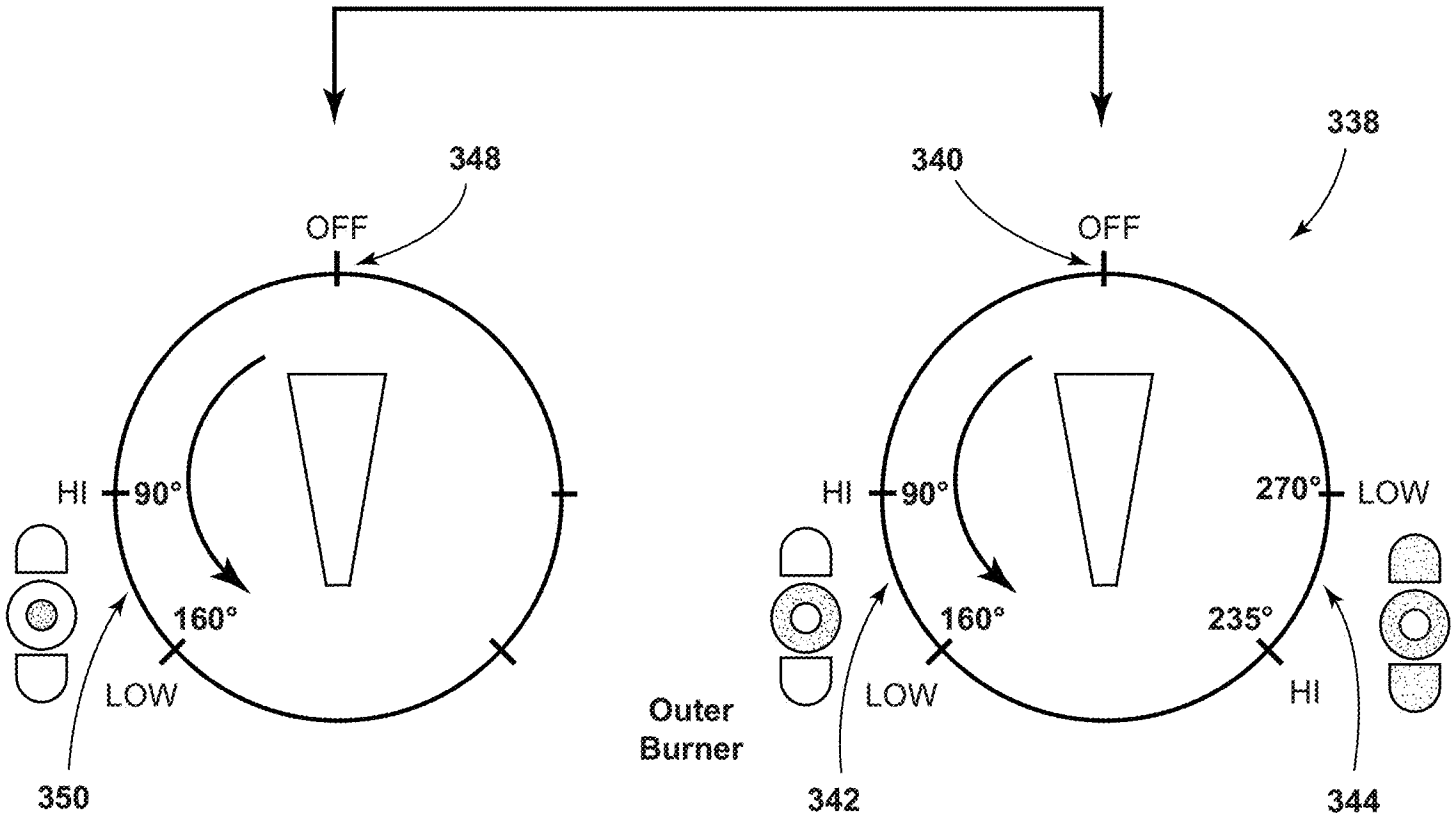
FIG. 15 is a schematic view illustrating a control scheme useable with the fuel supply line configuration of FIG. 14.

In an alternative embodiment shown in FIGS. 14 and 15, a burner unit 210 that is configured similarly to the burner unit 10, described above, unless otherwise specified (and in which like numbering increased by 200 is used to refer to similar features), includes first, second, and third fuel supply lines 326, 328, and 330 that attach separately with the holder 302. In generally the same manner discussed above, the first and second fuel supply lines 326 and 328 are respectively associated with the first and second extension sections 18 and 20 and with the first and second arced segments 32*a* and 32*b*. A third supply line 336 connects with holder 302 to provide fuel to the simmer burner 274 in a similar manner to that which is discussed above with respect fourth supply line 136. In the present embodiment, a first valve 338 is coupled with the first and second fuel supply lines 326 and 328 and is selectively moveable from a first position 340 (FIG. 15), in which the valve 338 is closed with respect to the first and second fuel supply lines 326 and 328 into a first range of movement 342 that provides an adjustable flow of fuel to the second fuel supply line 328 only. The first valve 338 is further moveable into and through a second range of motion 344 that simultaneously provides an adjustable flow of fuel to the first and second fuel supply lines 326 and 338. A separate second valve 348 is coupled with the third fuel supply line 330 and is selectively moveable from its own first position 350, in which the valve 348 is closed with respect to the fourth fuel supply line 336 and through a range of movement 352 for adjusting a separate flow of fuel to the third fuel supply line 336. In this manner, the valves 338 and 348 separately control the outer burner 298 and the simmer burner 274, respectively.

Figure 16:
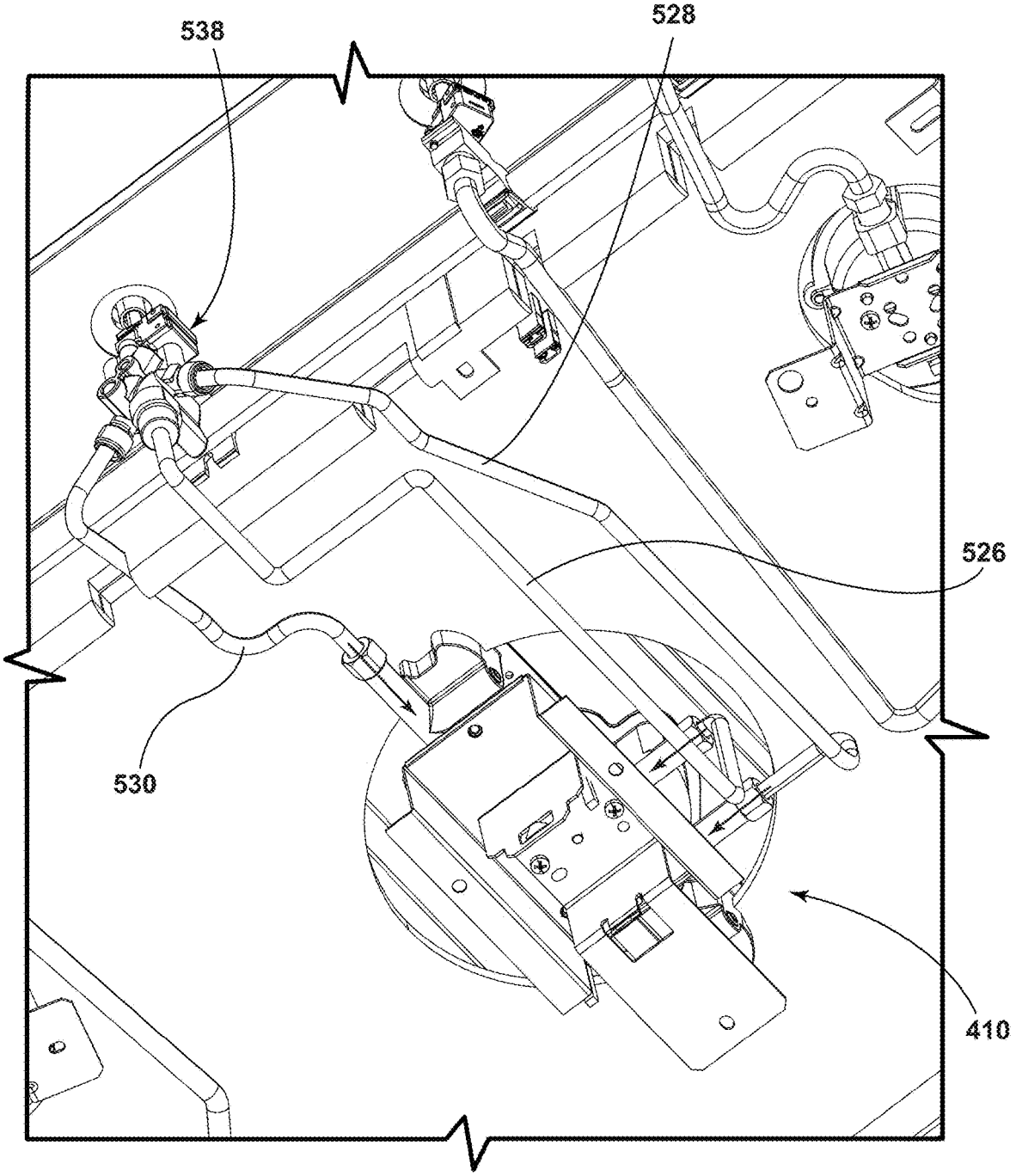
FIG. 16 is a perspective view of the burner unit of FIG. 1 showing an alternative fuel supply line arrangement associated therewith in another implementation.
Figure 17:
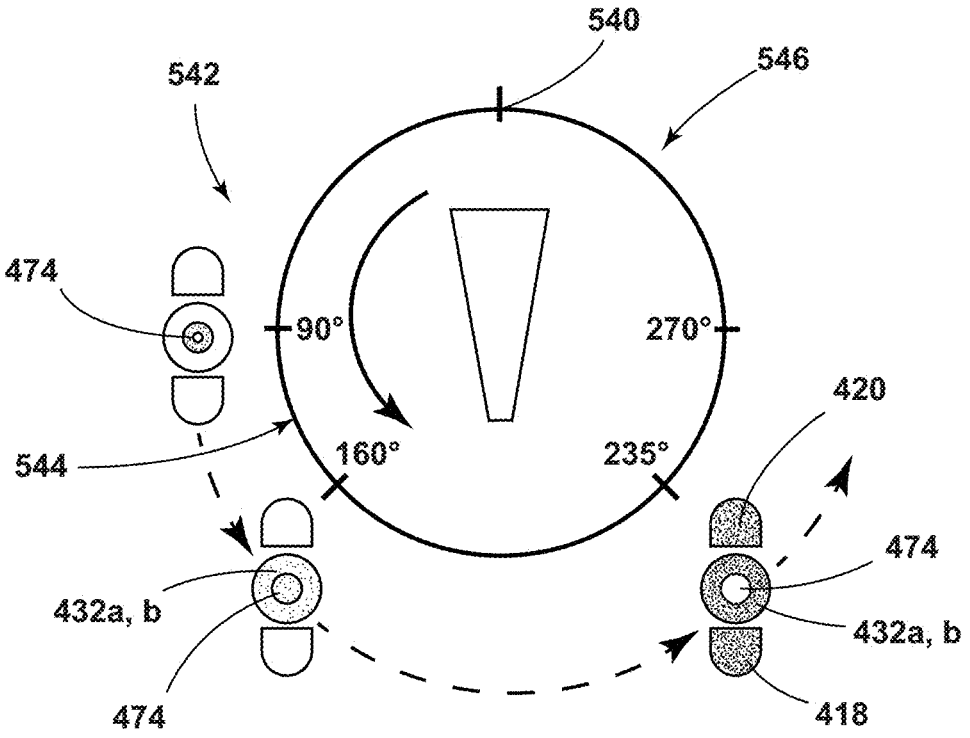
FIG. 17 is a schematic view illustrating an alternative control scheme useable with the fuel supply line configuration of FIG. 16.

In a further alternative embodiment shown in FIGS. 16 and 17, a burner unit 410 that is configured similarly to the burner unit 10, described above, unless otherwise specified (and in which like numbering increased by 400 is used to refer to similar features), includes first, second, and third fuel supply lines 526, 528, and 530 that attach separately with the holder 502. A triple valve 538 is coupled with each of the fuel supply lines 526, 528 and 530 for controlling the flow of fuel to the simmer burner 474, the arced sections 432*a* and 432*b* and the extension sections 418 and 420 in a successive manner. As illustrated in FIG. 17, rotation of the knob 546 associated with valve 538 occurs from an initial position 540, wherein the valve 538 remains closed to all of the fuel supply lines 526, 528, and 530, into a first range of motion 542, wherein fuel is provided to the third fuel supply line 530 for use and control of the simmer burner 474. In particular, the fuel provided to the simmer burner 474 increases with movement away from the initial position 540 through the first range of motion 542 with the simmer burner 474 being maintained at the maximum output level at the end of the first range of motion 542 and beyond. As further illustrated, when knob 546 is moved into the second range of motion 544, fuel is additionally provided to the arced sections 432*a* and 432*b* via the second supply line in an increasing manner with movement through the second range of motion 544. Movement of knob 546 into the third range of motion 546 maintains both the simmer burner 474 and arced sections 432*a* and 432*b* at their maximum output levels, while providing fuel to the extension sections 418 and 420 at an increasing amount with continued movement through the third range of motion 546.

Additional aspects of the present disclosure are described in the following paragraphs and all possible combinations thereof. According one such aspect of the present disclosure, a cooking burner includes a spreader defining a first side wall defining an outer profile having first and second extension sections opposed about a first axis, each having a semi-circular end segment with first and second parallel straight segments extending parallel with the first axis from opposite ends of the semi-circular segment. The spreader further defines first and second arced sections, each extending outwardly along a second axis perpendicular to the first axis from and between the first parallel straight segments and second parallel straight segments of the first and second extension sections, respectively. The spreader further defines a second side wall defining a circular profile disposed inwardly of and concentric with the first and second arced sections and a plurality of fuel outlets extending through both the first side wall and the second side wall. A circular inner cap is assembled with an upper portion of the circular inner profile, an annular outer cap is assembled with respective upper portions of the first and second arced sections, and first and second extension caps assembled with respective upper portions of the first and second extension sections.

The spreader further may define an interior wall segment separating an interior of the spreader into a first extension fuel mixing chamber within the portion of the first side wall defining the first extension section of the outer profile and an outer circular fuel mixing chamber within the portions of the first side wall defining the first and second arced sections.

The spreader may further define a third side wall defining an interior profile separating the interior of the spreader, within an outer circular fuel mixing chamber within the portions of the first side wall defining the first and second arced sections, and an inner open section of the spreader and a pair of channel walls extending from the third side wall to the first side wall and defining a carryover channel between the inner open section of the spreader and a second extension fuel mixing chamber within the portion of the first side wall defining the first extension section of the outer profile.

The channel walls may taper outwardly from the third side wall to the first side wall.

The cooking burner may further include a holder supporting the spreader and an ignition electrode at an intersection of the first arced section and the first extension section, and the ignition electrode activates to cause ignition of a fuel-air mixture flowing through first ones of the fuel outlets within the first arced section and the first extension section with the carryover channel promoting ignition of second ones of the fuel outlets within the second arced section.

The cooking burner may further include an ignition electrode disposed adjacent with second side wall, and the ignition electrode activates to cause ignition of a fuel-air mixture flowing through first ones of the fuel outlets extending through the second side wall with the carryover channel promoting ignition of second ones of the fuel outlets through the first side wall.

The second side wall may define a central fuel mixing chamber and is disposed within the inner open section of the spreader and one of the plurality of fuel outlets extending through the second side wall defines a pilot flame outlet and is directed toward the carryover channel.

The first side wall may define an upper edge along the outer profile, the upper edge being disposed at a consistent height above a lower surface of the spreader through the first and second extension sections and the first and second arced sections.

Ones of the plurality of fuel outlets extending through the first side wall may further extend through and are open on an upper surface of the first side wall, and the first and second extension caps may define a lower inside surface enclosing upper portions of ones of the plurality of fuel outlets extending through the first side wall within the respective first and second extension sections and diverter ridge extending from a lower inside surface thereof at a position disposed inwardly of an interior of the first side wall and partially overlapping with at least some of the ones of the plurality of fuel outlets.

The spreader may further define a lower surface from which the first side wall extends in a direction generally perpendicular to the lower surface, a first interior portion of the spreader being disposed within the first side wall and a corresponding portion of the lower surface, first and second inlet ports through the lower surface of the spreader and open to the first interior portion, the first inlet port being disposed within the first extension section and the second inlet port disposed within the second extension section. A plurality of lower ribs may extend from the lower surface in a direction opposite the first side wall, at least one of the plurality of lower ribs surrounding and being spaced apart from the first inlet port, and at least one of the plurality of lower ribs surrounding and being spaced apart from the second inlet port.

The cooking burner may further include a holder defining an interior fuel distribution chamber and supporting the spreader with the first and second inlet ports being in fluid communication with the interior fuel distribution chamber and the lower surface of the spreader being spaced from an upper edge of the holder to define an inflow path through a portion of the fuel distribution chamber and into the first and second inlet ports, and the lower ribs extend past the upper edge of the holder partially into the fuel distribution chamber to deflect a portion of an air flow through the primary inflow path away from the openings.

The cooking burner may further include first, second, third, and fourth fuel supply lines respectively associated with the first extension section, the second extension section, the first and second arced segments, and the second side wall. The cooking burner may also include a bidirectional valve coupled with the first, second, third, and fourth fuel supply lines and selectively moveable from a central position in which the valve is closed with respect to the first, second, third, and fourth fuel supply lines into a first range of movement, adjusting a flow of fuel to the fourth fuel supply line while remaining closed with respect to the first, second, and third fuel supply lines, and a second range of movement adjusting a flow of fuel to the first, second, third, and fourth fuel supply lines simultaneously.

The cooking burner may further include first, second, third, and fourth fuel supply lines respectively associated with the first extension section, the second extension section, the first and second arced segments, and the second side wall. A first valve may be coupled with the first, second, and third fuel supply lines and is selectively moveable from first position in which the valve is closed with respect to the first, second, and third fuel supply lines into a first range of movement, adjusting a flow of fuel to the first, second, and third fuel supply lines simultaneously. A second valve may be coupled with the fourth fuel supply line and selectively moveable from a first position in which the valve is closed with respect to the fourth fuel supply line into a first range of movement, adjusting a flow of fuel to the fourth fuel supply line.

According to another aspect, a cooking hob includes an upper cooktop surface and a burner unit supported along a portion of the cooktop surface. The burner unit includes a spreader defining a first side wall defining an outer profile having first and second extension sections opposed about a first axis, each having a semi-circular end segment with first and second parallel straight segments extending parallel with the first axis from opposite ends of the semi-circular segment. The spreader further defines first and second arced sections, each extending outwardly along a second axis perpendicular to the first axis from and between the first parallel straight segments and second parallel straight segments of the first and second extension sections, respectively. The spreader further defines a second side wall defining a circular profile disposed inwardly of and concentric with the first and second arced sections and a plurality of fuel outlets extending through both the first side wall and the second side wall. A circular inner cap is assembled with an upper portion of the circular inner profile, an annular outer cap is assembled with respective upper portions of the first and second arced sections, and first and second extension caps assembled with respective upper portions of the first and second extension sections.

The spreader may further have a second side wall defining a circular profile disposed inwardly of and concentric with the first and second arced sections with a second plurality of fuel outlets extending through the second side wall, and the burner unit further includes a circular inner cap assembled with an upper portion of the circular inner profile.

The cooking hob may further include first, second, and third fuel supply lines associated with the first extension section, the second extension section, the first and second arced segments, and the second side wall. A bidirectional valve may be coupled with the first and second fourth fuel supply lines and is selectively moveable from a central position in which the valve is closed with respect to the first and second fuel supply lines into a first range of movement, adjusting a flow of fuel to the third fuel supply line while remaining closed with respect to the first and second fuel supply lines, and a second range of movement adjusting a flow of fuel to the first and second fuel supply lines while remaining closed with respect to the third fuel supply line.

The spreader may further define a third side wall defining an interior profile separating the interior of the spreader, within an outer circular fuel mixing chamber within the portions of the first side wall defining the first and second arced sections, and an inner open section of the spreader and a pair of channel walls extending from the third side wall to the first side wall and defining a carryover channel between the inner open section of the spreader and a second extension fuel mixing chamber within the portion of the first side wall defining the first extension section of the outer profile.

The first plurality of fuel outlets may further extend through and are open on an upper surface of the first side wall, and the first and second extension caps define a lower inside surface enclosing upper portions of ones of the plurality of fuel outlets extending through the first side wall within the respective first and second extension sections and diverter ridge extending from a lower inside surface thereof at a position disposed inwardly of an interior of the first side wall and partially overlapping with at least some of the ones of the plurality of fuel outlets.

The spreader may further define a lower surface from which the first side wall extends in a direction generally perpendicular to the lower surface, a first interior portion of the spreader being disposed within the first side wall and a corresponding portion of the lower surface. The spreader further first and second inlet ports through the lower surface of the spreader and open to the first interior portion, the first inlet port being disposed within the first extension section and the second inlet port disposed within the second extension section. A plurality of lower ribs may extend from the lower surface in a direction opposite the first side wall, at least one of the plurality of lower ribs surrounding and being spaced apart from the first inlet port, and at least one of the plurality of lower ribs surrounding and being spaced apart from the second inlet port. The burner unit may further include a holder defining an interior fuel distribution chamber and supporting the spreader with the first and second inlet ports being in fluid communication with the interior fuel distribution chamber and the lower surface of the spreader being spaced from an upper edge of the holder to define an inflow path through a portion of the fuel distribution chamber and into the first and second inlet ports. The lower ribs may extend past the upper edge of the holder partially into the fuel distribution chamber to deflect a portion of an air flow through the primary inflow path away from the openings According to yet another aspect, a method for controlling a cooking burner includes positioning a bidirectional valve coupled with the first, second, third, and fourth fuel supply lines in a central position in which the valve is closed with respect to the first, second, third, and fourth fuel supply lines, thereby maintaining the burner in an off condition and moving the bidirectional valve into a first range of movement to adjust a flow of fuel to the fourth fuel supply line while remaining closed with respect to the first, second, and third fuel supply lines to control the flow of fuel to a circular profile disposed inwardly of and concentric with first and second arced sections, while maintaining a flow of fuel to first and second extension sections of the burner that are opposed about a first axis and the first and second arced sections, which extend outwardly along a second axis perpendicular to the first axis from and between the first and second extension sections, in an off condition. The method further includes moving the bidirectional valve into a second range of movement adjusting the flow of fuel to the first, second, and third fuel supply lines simultaneously to control the flow of fuel to the first and second extension sections, the first and second arced sections, and the circular profile.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A cooking burner, comprising:

a spreader defining:

a first side wall defining an outer profile having first and second extension sections opposed about a first axis, each having a semi-circular end segment with first and second parallel straight segments extending parallel with the first axis from opposite ends of the semi-circular segment, the spreader further defining first and second arced sections, each extending outwardly along a second axis perpendicular to the first axis from and between the first parallel straight segments and second parallel straight segments of the first and second extension sections, respectively;

a second side wall defining a circular profile disposed inwardly of and concentric with the first and second arced sections; and a plurality of fuel outlets extending through both the first side wall and the second side wall;

a circular inner cap assembled with an upper portion of the circular inner profile;

an annular outer cap assembled with respective upper portions of the first and second arced sections; and first and second extension caps assembled with respective upper portions of the first and second extension sections.

2. The cooking burner of claim 1, wherein the spreader further defines an interior wall segment separating an interior of the spreader into a first extension fuel mixing chamber within the first extension section of the outer profile and an outer circular fuel mixing chamber within the first and second arced sections.

3. The cooking burner of claim 1, wherein the spreader further defines:

a third side wall defining an interior profile separating the interior of the spreader, within an outer circular fuel mixing chamber within the first and second arced sections, and an inner open section of the spreader; and a pair of channel walls extending from the third side wall to the first side wall and defining a carryover channel between the inner open section of the spreader and a second extension fuel mixing chamber within the first extension section of the outer profile.

4. The cooking burner of claim 3, wherein the channel walls taper outwardly from the third side wall to the first side wall.

5. The cooking burner of claim 3, further including a holder supporting the spreader and an ignition electrode at an intersection of the first arced section and the first extension section, wherein:

the ignition electrode activates to cause ignition of a fuel-air mixture flowing through first ones of the fuel outlets, within the first arced section and the first extension section, with the carryover channel promoting ignition of second ones of the fuel outlets within the second arced section.

6. The cooking burner of claim 3, further including an ignition electrode disposed adjacent to the second side wall, wherein:

the ignition electrode activates to cause ignition of a fuel-air mixture flowing through first ones of the fuel outlets extending through the second side wall, with the carryover channel promoting ignition of second ones of the fuel outlets extending through the first side wall.

7. The cooking burner of claim 3, wherein:

the second side wall defines a central fuel mixing chamber and is disposed within the inner open section of the spreader; and one of the plurality of fuel outlets extending through the second side wall defines a pilot flame outlet and is directed toward the carryover channel.

8. The cooking burner of claim 1, wherein the first side wall defines an upper edge along the outer profile, the upper edge being disposed at a consistent height above a lower surface of the spreader through the first and second extension sections and the first and second arced sections.

9. The cooking burner of claim 1, wherein ones of the plurality of fuel outlets extending through the first side wall extend through and are open on an upper surface of the first side wall; and the first and second extension caps define a lower inside surface enclosing upper portions of ones of the plurality of fuel outlets extending through the first side wall within the respective first and second extension sections and diverter ridge extending from a lower inside surface thereof at a position disposed inwardly of an interior of the first side wall and partially overlapping with at least some of the ones of the plurality of fuel outlets.

10. The cooking burner of claim 1, wherein the spreader further defines:

a lower surface from which the first side wall extends in a direction generally perpendicular to the lower surface, a first interior portion of the spreader being disposed within the first side wall and a corresponding portion of the lower surface;

first and second inlet ports through the lower surface of the spreader and open to the first interior portion, the first inlet port being disposed within the first extension section and the second inlet port disposed within the second extension section;

a plurality of lower ribs extending from the lower surface in a direction opposite the first side wall, at least one of the plurality of lower ribs surrounding and being spaced apart from the first inlet port, and at least one of the plurality of lower ribs surrounding and being spaced apart from the second inlet port.

11. The cooking burner of claim 10, further including a holder defining an interior fuel distribution chamber and supporting the spreader with the first and second inlet ports being in fluid communication with the interior fuel distribution chamber and the lower surface of the spreader being spaced from an upper edge of the holder to define an inflow path through a portion of the fuel distribution chamber and into the first and second inlet ports, wherein:

the lower ribs extend past the upper edge of the holder partially into the fuel distribution chamber to deflect a portion of an air flow through the primary inflow path away from adjacent ones of the plurality of fuel outlets.

12. The cooking burner of claim 1, further including:

first and second fuel supply lines respectively associated with the first extension section, the second extension section, and the first and second arced sections, and the second side wall; and a bidirectional valve coupled with the first and second fuel supply lines and selectively moveable from a central position in which the valve is closed with respect to the first and second fuel supply lines into a first range of movement, adjusting a flow of fuel to the second fuel supply line while remaining closed with respect to the first fuel supply line, and a second range of movement adjusting the flow of fuel to the first fuel supply line while remaining closed with respect to the second fuel supply line.

13. The cooking burner of claim 1, further including:

first, second, and third fuel supply lines respectively associated with the first extension section and the second extension section, the first and second arced section, and the second side wall; and a first valve coupled with the first and second fuel supply lines and selectively moveable from first position in which the valve is closed with respect to the first and second fuel supply lines into a first range of movement, adjusting a flow of fuel to the first and second fuel supply lines simultaneously; and a second valve coupled with the third fuel supply line and selectively moveable from a first position in which the valve is closed with respect to the third fuel supply line into a first range of movement, adjusting the flow of fuel to the third fuel supply line.

14. A cooking hob, comprising:

an upper cooktop surface;

a burner unit supported along a portion of the cooktop surface and including:

a spreader having a first side wall defining an outer profile having first and second extension sections opposed about a first axis, each having a semi-circular end segment with first and second parallel straight segments extending parallel with the first axis from opposite ends of the semi-circular segment, the spreader further defining first and second arced sections, each extending outwardly along a second axis perpendicular to the first axis from and between the first parallel straight segments and second parallel straight segments of the first and second extension sections, respectively, a first plurality of fuel outlets extending through both the first side wall;

an annular outer cap assembled with respective upper portions of the first and second arced sections; and first and second extension caps assembled with respective upper portions of the first and second extension sections.

15. The cooking hob of claim 14, wherein:

the spreader further has a second side wall defining a circular profile disposed inwardly of and concentric with the first and second arced sections with a second plurality of fuel outlets extending through the second side wall; and the burner unit further includes a circular inner cap assembled with an upper portion of the circular inner profile.

16. The cooking hob of claim 15, further including:

first, second, and third fuel supply lines respectively associated with the first extension section and the second extension section, the first and second arced sections, and the second side wall; and a triple valve coupled with the first, second, and third fuel supply lines and selectively moveable from a central position in which the valve is closed with respect to the first, second, and third fuel supply lines into a first range of movement, adjusting a flow of fuel to the third fuel supply line while remaining closed with respect to the first and second fuel supply lines, a second range of movement maintaining the flow of fuel to the third fuel supply line and adjusting the flow of fuel to the second fuel supply line, and a third range of movement maintaining the flow of fuel to the second and third fuel supply lines and adjusting the flow of fuel to the first fuel supply line.

17. The cooking hob of claim 14, wherein the spreader further defines:

a third side wall defining an interior profile separating the interior of the spreader, within an outer circular fuel mixing chamber within the first and second arced sections, and an inner open section of the spreader; and a pair of channel walls extending from the third side wall to the first side wall and defining a carryover channel between the inner open section of the spreader and a second extension fuel mixing chamber within the first extension section of the outer profile.

18. The cooking hob of claim 14, wherein the plurality of fuel outlets further extend through and are open on an upper surface of the first side wall; and the first and second extension caps define a lower inside surface enclosing upper portions of ones of the plurality of fuel outlets extending through the first side wall within the respective first and second extension sections and diverter ridge extending from a lower inside surface thereof at a position disposed inwardly of an interior of the first side wall and partially overlapping with at least some of the ones of the plurality of fuel outlets.

19. The cooking hob of claim 14, wherein:

the spreader further defines:

a lower surface from which the first side wall extends in a direction generally perpendicular to the lower surface, a first interior portion of the spreader being disposed within the first side wall and a corresponding portion of the lower surface;

first and second inlet ports through the lower surface of the spreader and open to the first interior portion, the first inlet port being disposed within the first extension section and the second inlet port disposed within the second extension section; and a plurality of lower ribs extending from the lower surface in a direction opposite the first side wall, at least one of the plurality of lower ribs surrounding and being spaced apart from the first inlet port, and at least one of the plurality of lower ribs surrounding and being spaced apart from the second inlet port;

the burner unit further includes a holder defining an interior fuel distribution chamber and supporting the spreader with the first and second inlet ports being in fluid communication with the interior fuel distribution chamber and the lower surface of the spreader being spaced from an upper edge of the holder to define an inflow path through a portion of the fuel distribution chamber and into the first and second inlet ports; and the lower ribs extend past the upper edge of the holder partially into the fuel distribution chamber to deflect a portion of an air flow through the primary inflow path away from adjacent ones of the plurality of fuel outlets.

* * * * *